US011489246B2

(12) United States Patent
Olson

(10) Patent No.: US 11,489,246 B2
(45) Date of Patent: Nov. 1, 2022

(54) SIGHTING BRACKET FOR ANTENNA ALIGNMENT

(71) Applicant: SMARTSKY NETWORKS, LLC, Morrisville, NC (US)

(72) Inventor: Wayne Olson, Pittsboro, NC (US)

(73) Assignee: SMARTSKY NETWORKS, LLC, Morrisville, NC (US)

( * ) Notice: Subject to any disclaimer, the term of this patent is extended or adjusted under 35 U.S.C. 154(b) by 129 days.

(21) Appl. No.: 17/254,943

(22) PCT Filed: Jun. 25, 2019

(86) PCT No.: PCT/US2019/038941
§ 371 (c)(1),
(2) Date: Dec. 22, 2020

(87) PCT Pub. No.: WO2020/005913
PCT Pub. Date: Jan. 2, 2020

(65) Prior Publication Data

US 2021/0126338 A1 Apr. 29, 2021

Related U.S. Application Data

(60) Provisional application No. 62/692,060, filed on Jun. 29, 2018.

(51) Int. Cl.
*H01Q 1/12* (2006.01)
*H01Q 1/24* (2006.01)

(52) U.S. Cl.
CPC ..... *H01Q 1/125* (2013.01); *H01Q 1/246* (2013.01)

(58) Field of Classification Search
CPC ..... H01Q 1/125; H01Q 1/1228; H01Q 1/246; H01Q 1/1207; H01Q 1/1242
See application file for complete search history.

(56) References Cited

U.S. PATENT DOCUMENTS

2011/0225804 A1 9/2011 Clifford et al.
2014/0266925 A1* 9/2014 Dalmazzo ..... G01S 19/14 343/702

FOREIGN PATENT DOCUMENTS

EP 3059603 A1 8/2016

OTHER PUBLICATIONS

International Search Report and Written Opinion of PCT/US2019/038941 dated Oct. 10, 2019, all enclosed pages cited.

* cited by examiner

*Primary Examiner* — Robert Karacsony
(74) *Attorney, Agent, or Firm* — Burr & Forman LLP

(57) ABSTRACT

An antenna alignment bracket may include a guide member having a first end and a second end, a first end plate disposed at the first end of the guide member to extend away from the guide member in a first direction that is substantially perpendicular to a direction of longitudinal extension of the guide member, a second end plate disposed at the second end of the guide member to extend away from the guide member in the first direction, and an extension portion operably coupled to one of the first end plate, the second end plate, or the guide member at a proximal end of the extension portion. The extension portion may be configured to support an alignment tool bracket for holding an alignment tool configured to align an antenna assembly at a distal end of the extension portion. A receiving space is defined between the first and second end plates to receive the antenna assembly.

20 Claims, 6 Drawing Sheets

FIG. 5
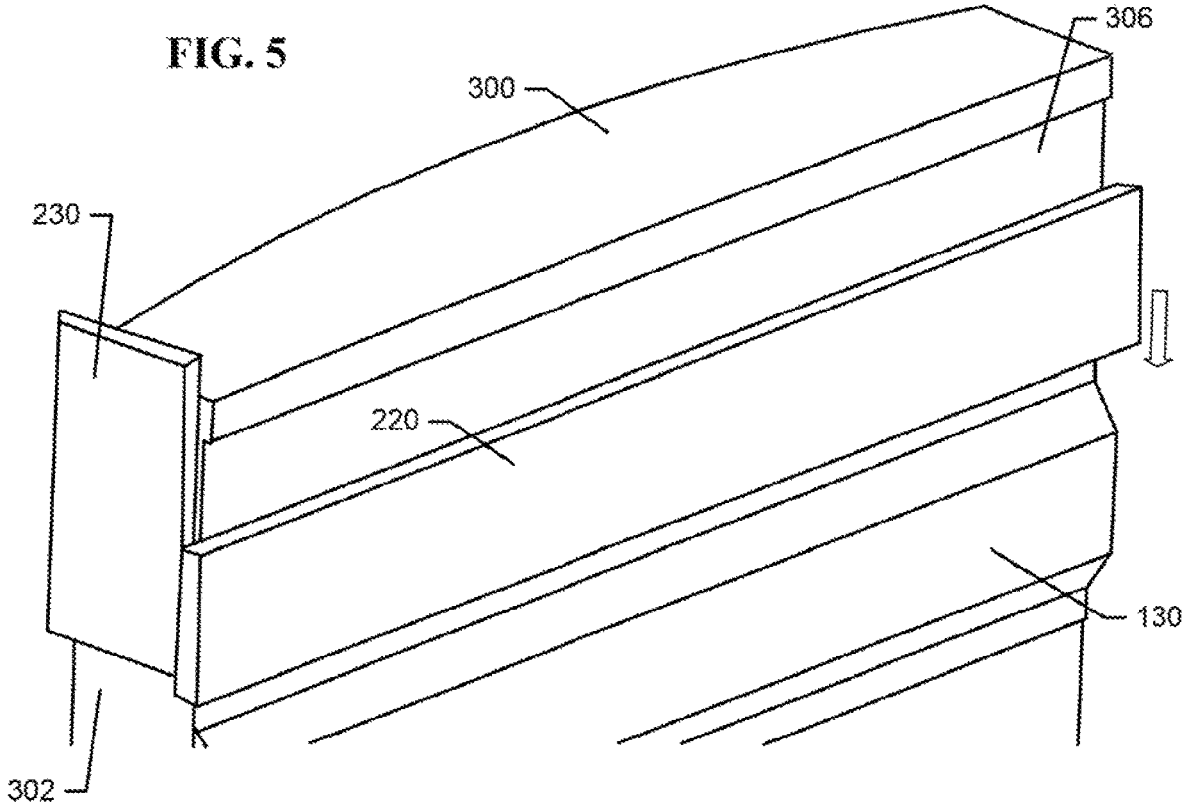
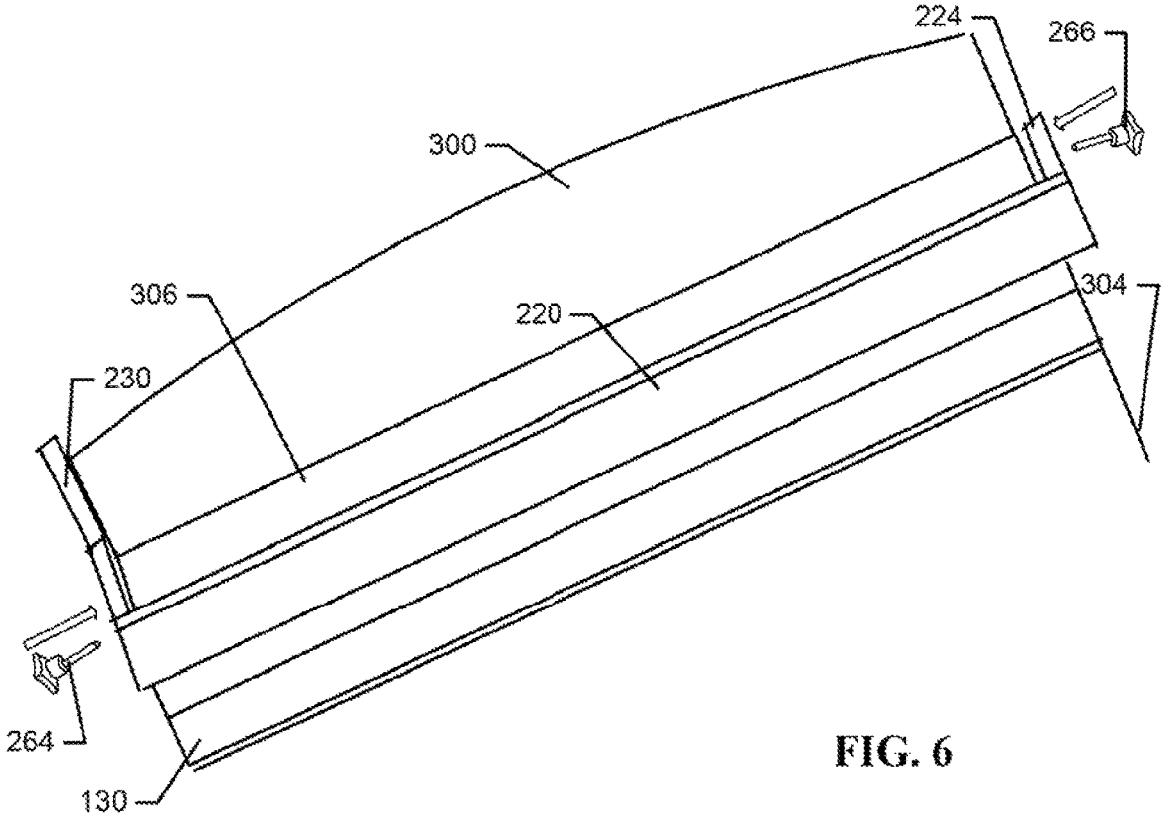
FIG. 6

FIG. 7
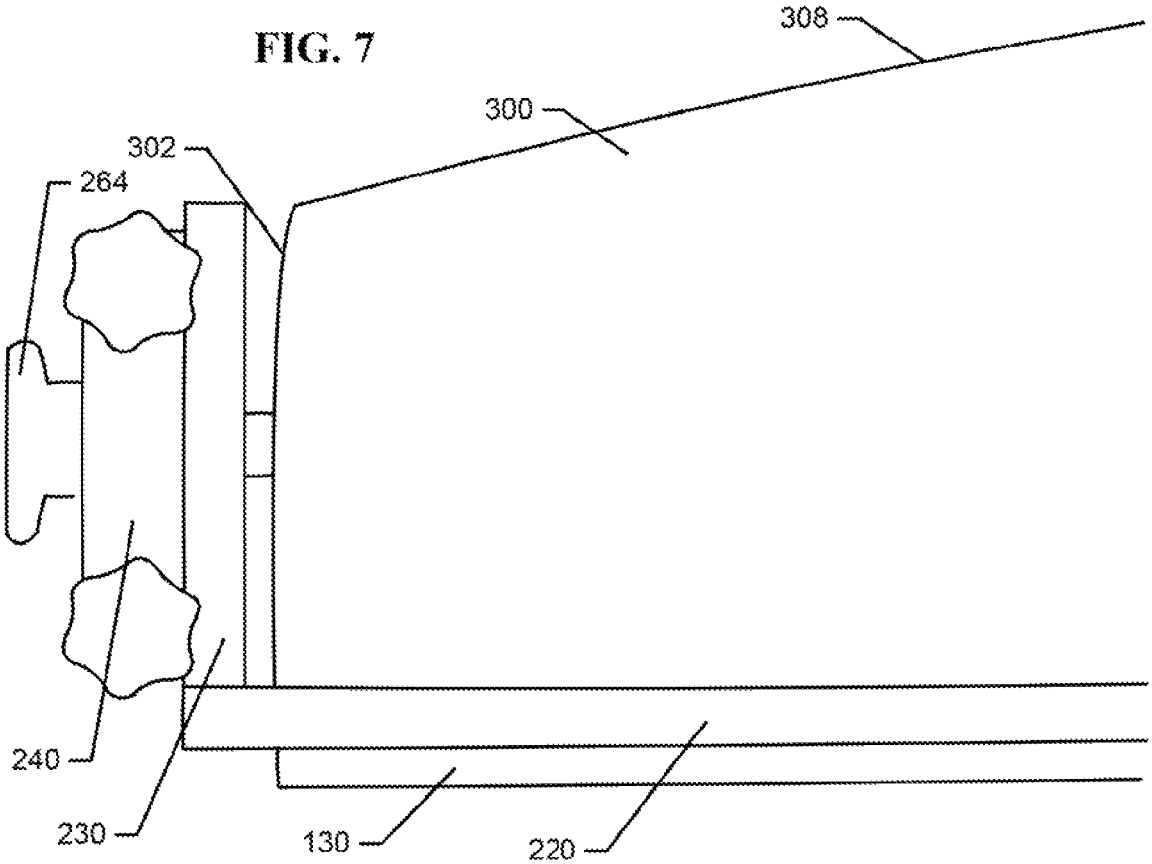
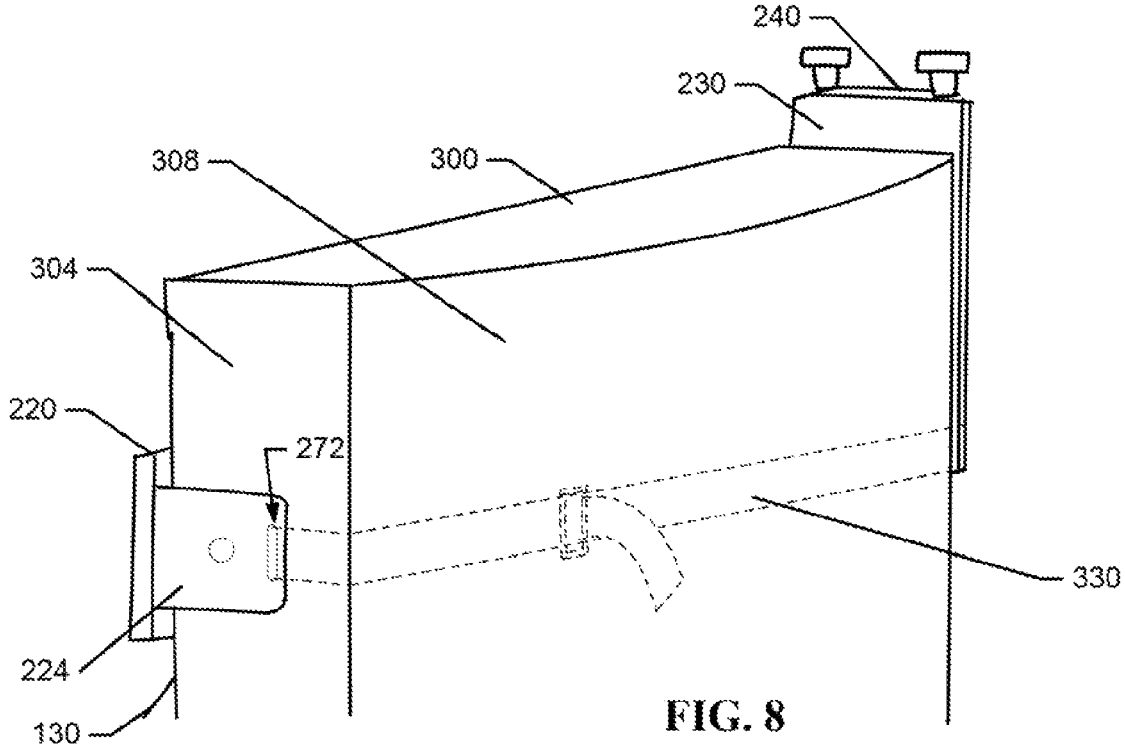
FIG. 8

SIGHTING BRACKET FOR ANTENNA ALIGNMENT

CROSS REFERENCE TO RELATED APPLICATIONS

This application claims priority to U.S. application No. 62/692,060 filed Jun. 29, 2018, the entire contents of which are hereby incorporated by reference in its entirety.

TECHNICAL FIELD

Example embodiments generally relate to antenna alignment and, more particularly, relate to a sighting bracket for antenna alignment of antenna assemblies with beamforming capabilities or that are otherwise required to have very small alignment tolerances.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

Over the years, towers have sprouted up all over the landscape to support antenna assemblies that provide these wireless connections. The antennas on these towers, many of which are panel antennas that have directional properties, are typically arranged to cover adjacent segments in order to define the desired coverage area around each tower. The installation of the antennas should be performed in accordance with the radio frequency (RF) design criteria that are defined for the antennas, which typically includes instructions for proper alignment of the antennas. If the antennas are not properly aligned, the noise floor for the antennas (and for the network) increases. Of course, a higher noise floor also means lower throughput for the network.

In order to ensure that antennas are properly aligned upon installation, numerous methods and tools could be employed. However, one of the most efficient methods available is to use a portable suite of alignment tools that can be temporarily attached to an antenna. The suite includes an alignment instrument, which is configured to take basic measurements such as, for example, azimuth, tilt, roll and elevation. The measurements can be communicated to another device, which includes a user interface and could even be a smart phone or laptop in some cases, to enable the installer to adjust the antenna positioning in order to achieve desired alignment measurements. The suite also includes a bracket assembly that is used to provide the attachment mechanism needed to attach the alignment instrument to the antenna.

For legacy wireless communication networks, which typically have wider beam formation employed by the panel antennas used in the network, the portable suite described above has proven to be quite efficient and effective. These legacy wireless communication networks often operate over relatively short ranges due to limitations on available sight lines. However, recent advances in network communication technologies have resulted in panel antennas that can achieve much narrower beams that are used for communication over much longer distances. These panel antennas may be useful, for example, in air-to-ground (ATG) networks, or other long distance communication networks where long sight lines are possible to achieve.

The acceptable tolerances for alignment of patent antennas in legacy wireless communication networks has been about +/−4 or 5 degrees. However, beam forming antennas for long distance communication networks may require tolerances of +/−1 degree. Although the alignment instruments used in the suites described above are designed to be capable of achieving the tighter tolerances required, the inconsistency of installation personnel relative to achieving the tighter tolerances can be traced to slack or other inaccuracy that is introduced relative to the bracket assembly. In this regard, the bracket assembly is typically affixed to the antenna by placing a bracket against one surface of the antenna and then extending an adjustable strap around the other sides of the antenna. The adjustable strap is then tightened in some form, and the placement of the bracket and/or the tightening can introduce inconsistencies that affect the accuracy of the instrument readings. Thus, the process of strapping the bracket to one side of the antenna introduces too much variability to achieve the necessary tolerances for modern beamforming antennas.

BRIEF SUMMARY OF SOME EXAMPLES

Some example embodiments may provide a sighting bracket that is configured to contact three sides of the antenna assembly to increase the number and quality of the contact points of the bracket. Example embodiments may also provide a structure for contact with a backbone or other structural feature of the antenna assembly to further ensure quality contact and alignment with the antenna assembly. Accordingly, consistently repeatable results can be achieved relative to eliminating the leeway for inaccuracies in alignment tolerances, and eliminating the need for costly flight time to confirm proper network performance. Noise floor for the antenna, and the network may therefore be improved, and overall network throughput and performance may also be improved.

In one example embodiment, an antenna alignment bracket is provided. The antenna alignment bracket may include a guide member having a first end and a second end, a first end plate disposed at the first end of the guide member to extend away from the guide member in a first direction that is substantially perpendicular to a direction of longitudinal extension of the guide member, a second end plate disposed at the second end of the guide member to extend away from the guide member in the first direction, and an extension portion operably coupled to one of the first end plate, the second end plate, or the guide member at a proximal end of the extension portion. The extension portion may be configured to support an alignment tool bracket for holding an alignment tool configured to align an antenna assembly at a distal end of the extension portion. A receiving space is defined between the first and second end plates to receive the antenna assembly.

In another example embodiment, a method of attaching an alignment tool to an antenna assembly is provided. The antenna assembly includes a housing having a rear wall, a first side, a second side, a top wall and a front side. The method includes placing a guide member of an antenna alignment bracket proximate the rear wall such that a first end plate disposed at a first end of the guide member extends along the first side and a second end plate disposed at a second end of the guide member extends along the second side to receive the antenna assembly in a receiving space defined between the first and second end plates. The method may further include affixing the antenna alignment bracket to the antenna assembly, and operably coupling the alignment tool to an alignment tool bracket disposed at an extension portion of the antenna alignment bracket. The extension portion may extend from one of the first end plate, the second end plate, or the guide member.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 5 is a top, rear-left side, perspective view of the antenna assembly being mated with the alignment bracket in accordance with an example embodiment;

FIG. 6 shows a top, rear perspective view of the antenna assembly being mated with the alignment bracket in accordance with an example embodiment;

FIG. 7 illustrates a top view of the left side of the alignment bracket attaching to the left side of the antenna assembly in accordance with an example embodiment;

FIG. 8 illustrates a perspective view of the alignment bracket affixed to the panel antenna in accordance with an example embodiment;

DETAILED DESCRIPTION

Figure 1:
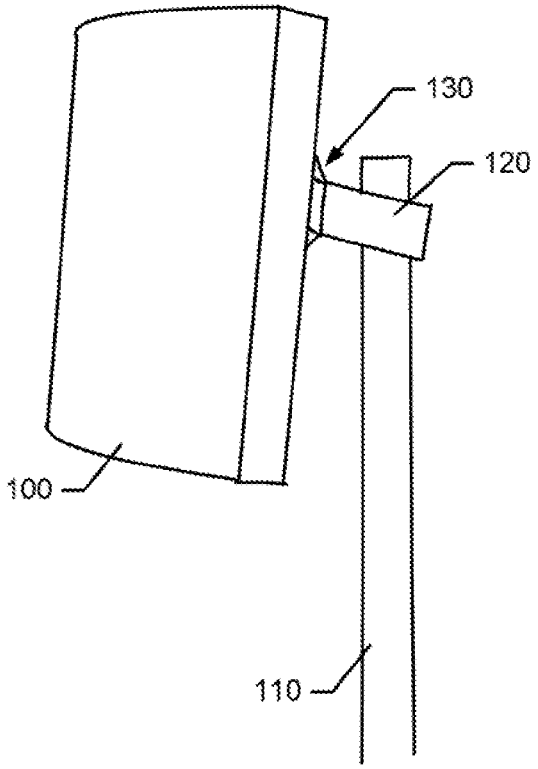
FIG. 1 illustrates a perspective view of an antenna assembly in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals may be used to refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments described herein provide a structure that is configured to mate with a panel antenna to enable alignment equipment to be attached to the panel antenna in a manner that allows superior accuracy to be achieved. In particular, panel antennas that are used for highly accurate beamforming applications (e.g., with beamwidths less than 8 degrees, and in some cases lower than 5 degrees), and that therefore require very tight tolerances for alignment (e.g., about +/−1 degree) tend to have a larger width than typical cellular network antennas. Example embodiments achieve the required alignment tolerances and do so by providing a rigid structure for a bracket assembly that is configured to be affixed securely to the panel antenna without the slack that is otherwise permitted by alignment using conventional means (which uses rigid structures on only one side of the antenna, and a flexible strap around the other three sides). Moreover, some example embodiments design the rigid structure of the bracket assembly to be mated to a corresponding rigid backbone or structure of the panel antenna to ensure proper alignment and that such alignment is made with a fixed and rigid structure that is the strongest point of the antenna assembly. Although some example embodiments are particularly well suited for use with antenna assemblies that include panel antennas or other directional antennas that employ beamforming, other structures and other types of antennas may also be used in connection with example embodiments.

FIG. 1 illustrates a perspective view of an antenna assembly 100 in accordance with an example embodiment. The antenna assembly is mounted to a pole 110, which may form or be part of a radio mast tower. As such, it should be appreciated that in many instances, the antenna assembly 100 will be one of multiple other antenna assemblies of the same and different wireless communication networks that may be attached to the same pole or radio mast tower.

The antenna assembly 100 may include a housing that is defined by top, bottom, side, front and rear walls. The front wall is typically made of a plastic material that is substantially invisible to RF energy, particularly in the frequency range at which the antenna assembly 100 is expected to operate. Meanwhile, the top, bottom, side and rear walls may be made of a metallic material to facilitate shielding of the antenna assembly 100 from interference from other collocated antennas. In some cases, the top, bottom, side and rear walls may be made of aluminum to reduce the weight of the antenna assembly 100.

The antenna assembly 100 may be operably coupled to the pole 110 via a mounting bracket 120. In some cases, because aluminum (particularly in thin sheets as may be present in the housing of the antenna assembly 100) is somewhat bendable, it may be desirable to attach the mounting bracket 120 to a more rigid structure than simply to the rear wall of the housing of the antenna assembly 100. Accordingly, in an example embodiment, a rigid metallic backbone-like structure may be provided to extend across the rear wall of the antenna assembly 100. This backbone-like structure may be referred to as a reinforcement member 130. The reinforcement member 130 of this example may extend from side to side across the rear wall of the antenna assembly and may extend substantially parallel to the planes formed by the top and bottom walls. The reinforcement member 130 may be spaced apart from the top wall, but may be closer to the top wall than the bottom wall. The reinforcement member 130 may be formed by riveting, welding, screwing, bolting or otherwise fastening two strips of metal (i.e., a top strip and a bottom strip) to the rear wall, and providing a protruding portion therebetween. The protruding portion may extend in a plane that is substantially parallel to the plane of the rear wall, and angled portions may extend upward from the protruding portion to the top strip, and downward from the protruding portion to the bottom strip in order to form the reinforcement member 130.

The mounting bracket 120 may be operably coupled to the reinforcement member 130 and to the pole 110 via bolts, screws or other fasteners. The mounting bracket 120 may be oriented in differing positions to change the orientation of the antenna assembly 100 relative to the pole 110. Thus, for example, the mounting bracket 120 may be adjusted to change the alignment of the antenna assembly 100 relative to the pole 110 (and the ground) to have a desired amount of tilt. The connection between the reinforcement member 130 and the mounting bracket 120 can be adjusted in order to alter the azimuth, roll and/or elevation.

As discussed above, the adjustments to the orientation of the antenna assembly 100 may be made using a suite of alignment tools. A conventional alignment tool would place a bracket on only one side (e.g., the rear wall or one of the side walls) of the antenna assembly 100, and then stretch one or more an adjustable straps around the other three sides. This method provides too much slack, and reduces the accuracy of the alignment. To avoid provision of this amount of slack, an alignment bracket 200 of an example embodiment may be employed.

Figure 4:
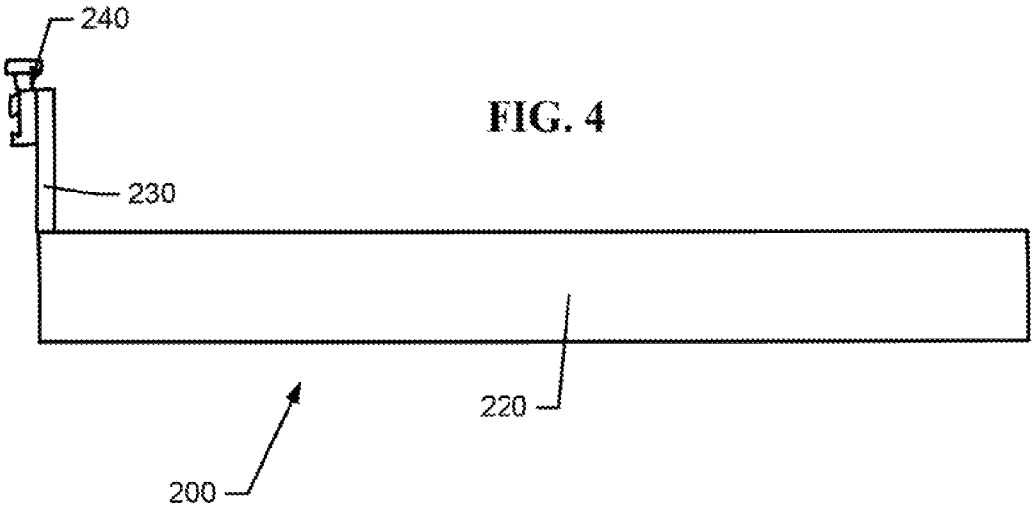
FIG. 4 is a rear view of the alignment bracket in accordance with an example embodiment.
Figure 3:
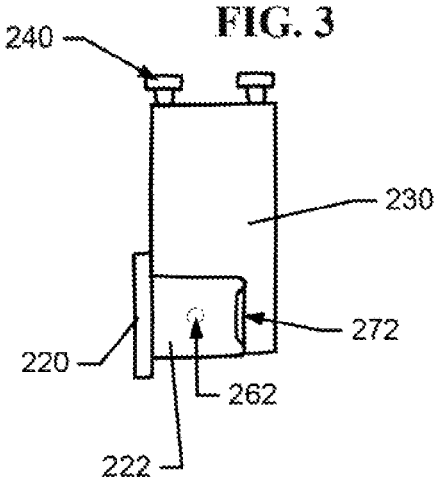
FIG. 3 is a side view of the alignment bracket in accordance with an example embodiment.
Figure 2:
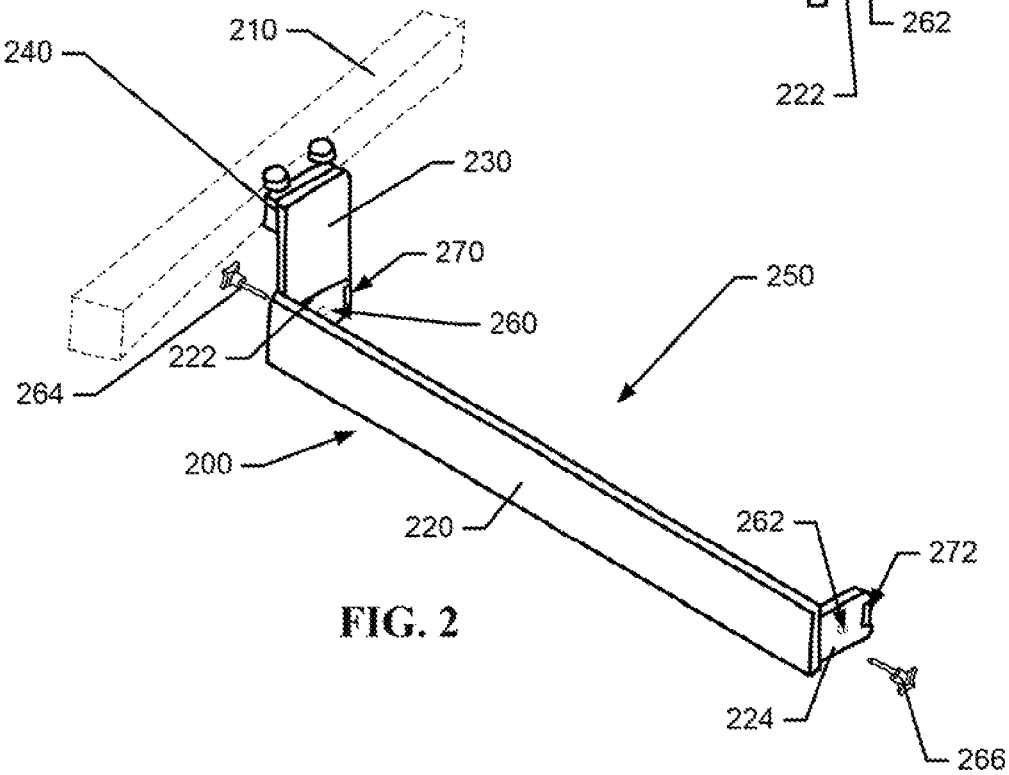
FIG. 2 illustrates a perspective view of an alignment bracket with alignment equipment attached thereto in accordance with an example embodiment.

FIGS. 2-8 illustrate the alignment bracket 200 from various perspectives. In this regard, FIG. 2 is a perspective view of the alignment bracket 200 showing alignment equipment (e.g., an alignment tool 210) attached thereto. FIG. 3 is a side view of the alignment bracket 200 and FIG. 4 is a rear view of the alignment bracket 200. FIG. 5 is a top, rear-left side, perspective view of the antenna assembly 100 being mated with the alignment bracket 200, while FIG. 6 shows a top, rear perspective view. FIG. 7 illustrates a top view of the left side of the alignment bracket 200 attaching to the left side of the antenna assembly 100. FIG. 8 illustrates a perspective view of the alignment bracket 200 affixed to the panel antenna 100 in accordance with an example embodiment.

Referring now to FIGS. 2-8, it can be appreciated that the alignment bracket 200 includes a guide member 220, a first end plate 222 and a second end plate 224. The guide member 220 may be an elongate member having a length that is substantially greater than each of the height and width dimensions thereof. Meanwhile the width may be relatively small compared to the height. The first and second end plates 222 and 224 may each have a width substantially equal to, or slightly smaller than, the width of the guide member 220, but may have a length that is much closer in size to that of the height of the guide member 220. The height of the first and second end plates 222 and 224 may be less than or equal to the height of the guide member 220.

As shown in FIGS. 2-4, the first and second end plates 222 and 224 may extend in the same direction away from the guide member 220 at opposite ends of the guide member 220. As such, for example, the first end plate 222 may extend away from a first end of the guide member 220 in a direction substantially perpendicular to the longitudinal length of the guide member 220. The second end plate 224 may extend away from a second end of the guide member 220 in a direction substantially perpendicular to the longitudinal length of the guide member 220, and parallel to the first end plate 222. An extension portion 230 may be extended upwardly from one of the first end plate 222 or the second end plate 224 relative to a plane in which each of the guide member 220, the first end plate 222 and the second end plate 224 may lie. However, it should be appreciated that the extension portion 230 could also be extended upwardly from the guide member 220 in some cases. Thus, for example, a proximal end of the extension portion 230 may be operably coupled to the corresponding one of the first or second end plate 222 or 224, or the guide member 220. The distal end of the extension portion 230 may support an alignment tool bracket 240 that is configured to hold the alignment tool 210 in place after the alignment bracket 200 is affixed to the antenna assembly 100.

As shown in FIG. 2, a receiving space 250 is defined between the first and second end plates 222 and 224 to allow the antenna assembly 100 to be received therein. The provision of the antenna assembly 100 into the receiving space 250 will align certain sides of the antenna assembly 100 with corresponding portions of the alignment bracket 200 as described in greater detail below. However, once the antenna assembly 100 is provided in the receiving space 250, the alignment bracket 200 includes some retention features that are shown in FIGS. 2-4. In this regard, the first end plate 222 includes a first orifice 260 provided at a portion thereof, and the second end plate 224 includes a second orifice 262 that may be disposed to mirror the first orifice 260. A first threaded fastener 264 may be configured to be passed through the first orifice 260 to operably couple the first end plate 222 to the side of the antenna assembly 100. Meanwhile, a second threaded fastener 266 may be passed through the second orifice 262 to operably couple the second end plate 224 to the opposite side of the antenna assembly 100. A first slot 270 may be disposed at a distal end of the first end plate 222, and a second slot 270 may be disposed at a distal end of the second end plate 224. After the antenna assembly 100 is inserted into the receiving space 250, the guide member 220, the first and second orifices 260 and 262, the first and second threaded fasteners 264 and 266, and the first and second slots 270 and 272 may be used to securely hold the alignment bracket 200 to the antenna assembly 100 as shown and described below in reference to FIGS. 5-8.

As shown in FIGS. 5-8, the antenna assembly 100 may include at least a top wall 300, a first sidewall 302, a second sidewall 304, a rear wall 306 and a front side (or panel) 308. As mentioned above, each of these walls/sides may be made of relatively thin metallic (e.g., aluminum) material. Accordingly, the reinforcement member 130 may be extended cross the rear wall 306 to provide reinforcement and a suitable reference for attachment of the alignment bracket 200 to the antenna assembly 100. In this regard, as shown in FIG. 5, the antenna assembly 100 may be inserted into the receiving space 250 such that the rear wall 306 is adjacent to the guide member 220 and the first sidewall 302 is adjacent to the extension portion 230. Although not visible in FIG. 5, the second end plate 224 will also be adjacent to the second sidewall 304.

Of note, the antenna assembly 100 is received in the receiving space 250 at a position that places the alignment bracket 200 above the reinforcement member 130. Thus, in order to properly position the alignment bracket 200 on the antenna assembly 100, the alignment bracket 200 may be slid downward (in the direction of the arrow in FIG. 5) until the bottom of the guide member 220 abuts with (e.g., aligns with and/or rests upon) the top of the reinforcement member 130. When the guide member 220 abuts the reinforcement member 130, the alignment bracket 200 may be properly positioned for being secured to the antenna assembly 100. Accordingly, as shown in FIG. 6, the first and second threaded fasteners 264 and 266 may be inserted (in the directions shown by the arrows) toward each other through the first and second orifices 260 and 262, respectively. The first and second threaded fasteners 264 and 266 may then be screwed in until they contact and retain the first sidewall 302 and second sidewall 304, respectively. At this point, the extension portion 230 should reach above the elevation of the top wall 300 (and through a plane formed thereby). Thus, the alignment tool bracket 240 is also above the top wall 300 and can hold the alignment tool 210 in a location where the alignment tool 210 can take accurate alignment measurements relative to the antenna assembly 100.

In some cases, the receiving space 250 may be slightly wider than the antenna assembly 100 so that there is a space between the first and second end plates 222 and 224 (and the extension portion 230) and the first sidewall 302 and second sidewall 304, respectively. FIG. 7 is a top view of the alignment tool bracket 240 and shows this space. The first threaded fastener 264 passes through the space to engage the first sidewall 302 to retain the alignment bracket 200 in attachment with the antenna assembly 100. As can also be appreciated from the view of FIG. 7, the reinforcement member 130 may extend away from the rear wall 306 by a greater distance than a width of the guide member 220.

In some cases, immediately after (or before) the first and second threaded fasteners 264 and 266 have been tightened to the antenna assembly 100, a strap 330 that extends between the first and second slots 270 and 272 may also be tightened across the front side 308 of the antenna assembly 100. The strap 330 may include a buckle assembly or any other suitable means for enabling the strap 330 to be tightened. Thus, as can be appreciated from the descriptions above, the guide member 220 may be supported at the rear wall 306 of the antenna assembly 100 by the reinforcement portion 130 first, and then the first and second end plates 222 and 224 may be supported at the first and second sidewalls 302 and 304 of the antenna assembly 100 by the first and second threaded fasteners 364 and 366, respectively. The strap 330 may also be tightened across the front side 308 of the antenna assembly 100 such that the alignment bracket 200 is supported by four different structures at four respective sides of the antenna assembly 100. This type of secure alignment to a visible and consistent reference point (i.e., the reinforcement member 130) by securing all four sides of the antenna assembly 100 with separate attachment means, ensures that the alignment bracket 200 can be securely and repeatably attached to antenna assemblies anywhere and by any crew without sacrificing accuracy. Accordingly, the measurements of tilt, roll and azimuth of the antenna assembly 100 can be accurately measured and aligned to ensure the noise floor of the antenna assembly 100 and the network can be maintained at a minimum level. Network throughput and performance may therefore also be increased.

Figure 9:
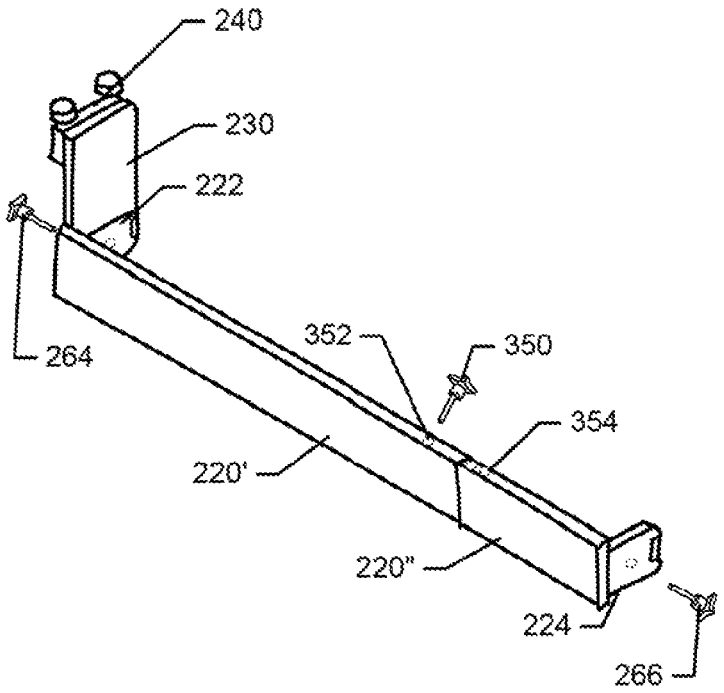
FIG. 9 illustrates an alignment bracket with a variable length guide member in accordance with an example embodiment.

Although the length of the guide member 220 can be standardized for specific antenna designs, it may also be possible to make the guide member 220 have a variable length so that the same alignment bracket 200 can be used to interface with multiple different sizes of antenna assembly 100. One way to make such a variable length guide member is shown in FIG. 9. In this regard, a sleeve 220' may be defined to have a slightly larger length and width than an insertion member 220" that slides into the sleeve 220'. The insertion member 220" can then be slid into the sleeve 220' to define the desired length for the guide member. In some cases, once the desired length is achieved, the sleeve 220' could be affixed to the insertion member 220". One way of achieving such affixing is shown in FIG. 9 as well. In this regard, for example, a threaded fastener 250 (or a pin or other such device) may be inserted through an orifice 352 formed in a portion of the sleeve 220' to engage a corresponding one of a plurality of orifices 354 formed in the insertion member 220". Upon insertion of the threaded fastener 350, the variable length guide member may be retained at the corresponding length. Of note, the extension portion 230 could also be adjustable in height using a similar structure (i.e., a sleeve and insertion portion that have variable connection points extending or contracting the height of the extension portion 230).

Figure 10:
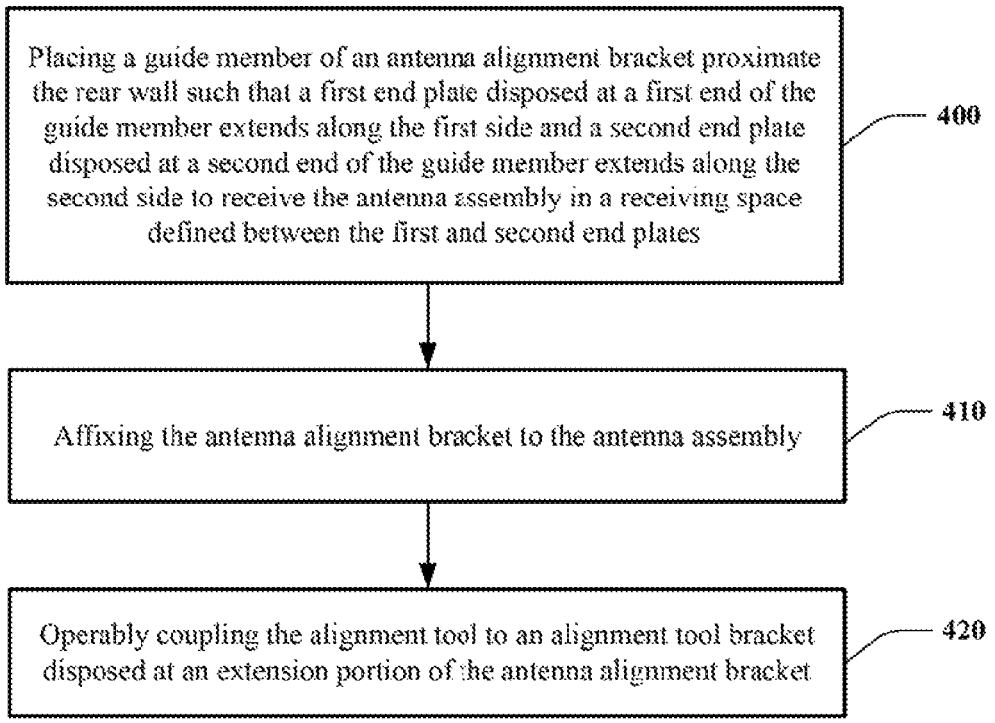
FIG. 10 illustrates a block diagram of a method of attaching an alignment bracket to an antenna assembly in accordance with an example embodiment.

FIG. 10 illustrates a block diagram of one method of attaching an alignment tool to an antenna assembly. Within the context of this method, it should be appreciated that the antenna assembly includes a housing having a rear wall, a first side, a second side, a top wall and a front side. As shown in FIG. 10, the method may include placing a guide member of an antenna alignment bracket proximate the rear wall such that a first end plate disposed at a first end of the guide member extends along the first side and a second end plate disposed at a second end of the guide member extends along the second side to receive the antenna assembly in a receiving space defined between the first and second end plates at operation 400. The method may further include affixing the antenna alignment bracket to the antenna assembly at operation 410, and operably coupling the alignment tool to an alignment tool bracket disposed at an extension portion of the antenna alignment bracket at operation 420. The extension portion may extend from one of the first or second end plates.

The method described above may include a number of augmentations, modifications or additional operations in some cases. These augmentations, modifications and/or additional operations can be optionally implemented in any combination. Some examples of such augmentations, modifications and additional operations include an augmentation in which affixing the antenna alignment bracket to the antenna assembly includes abutting the guide member to a reinforcement member extending across the rear wall in a direction from the first side to the second side, the reinforcement member being substantially parallel to a plane in which a top wall of the housing of the antenna assembly lies. In an example embodiment, affixing the antenna alignment bracket to the antenna assembly may include affixing the antenna alignment bracket to the antenna assembly such that the extension portion extends above the plane. In some cases, affixing the antenna alignment bracket to the antenna assembly may include passing a first threaded fastener a first orifice in the first end plate to engage the first side, and passing a second threaded fastener through a second orifice in the second end plate to engage the second side. In an example embodiment, affixing the antenna alignment bracket to the antenna assembly may include extending a strap from a first slot in the first end plate to a second slot in the second end plate and tightening the strap across the front side of the antenna assembly. In some cases, affixing the antenna alignment bracket to the antenna assembly may include sequentially abutting the guide member to a reinforcement portion disposed at the rear side, attaching a threaded fastener through each of the first and second end plates to engage the first and second sides, respectively, and tightening a strap across the front side of the antenna assembly such that the antenna alignment bracket is supported by four different structures at four respective sides of the antenna assembly. In an example embodiment, the method may further include adjusting a length of the guide member prior to placing the guide member of the antenna alignment bracket proximate the rear wall of the antenna assembly.

In accordance with an example embodiment, an antenna alignment bracket may include a guide member having a first end and a second end, a first end plate disposed at the first end of the guide member to extend away from the guide member in a first direction that is substantially perpendicular to a direction of longitudinal extension of the guide member, a second end plate disposed at the second end of the guide member to extend away from the guide member in the first direction, and an extension portion operably coupled to one of the first end plate, the second end plate, or the guide member at a proximal end of the extension portion. The extension portion may be configured to support an alignment tool bracket for holding an alignment tool configured to align an antenna assembly at a distal end of the extension portion. A receiving space is defined between the first and second end plates to receive the antenna assembly.

In some embodiments, the antenna alignment bracket may be provided with additional features, optional features, and/or the features described above may be modified or augmented. Some examples of modifications, optional features and augmentations are described below. It should be appreciated that the modifications, optional features and augmentations may each be added alone, or they may be added cumulatively in any desirable combination. In an example embodiment, the guide member may be configured to engage a rear wall of a housing of the antenna assembly, and the first and second end plates may be configured to extend parallel to respective side walls of the antenna assembly such that a front side of the antenna assembly faces away from the receiving space. In an example embodiment, the rear wall may include a reinforcement member extending across the rear wall in a direction from a first side wall to a second side wall. The reinforcement member may be substantially parallel to a plane in which a top wall of the housing of the antenna assembly lies. In some cases, the guide member may be configured to be operably coupled to the antenna assembly such that the guide member abuts the reinforcement member. In an example embodiment, the extension portion may be configured to extend above the plane of the top wall responsive to operable coupling of the guide member to the antenna assembly. In some cases, each of the first and second end plates may include a slot at a distal end thereof relative to the guide member, and a strap may be configured to pass between the slot of each of the first and second end plates across a front side of the antenna assembly. In an example embodiment, each of the first and second end plates may include an orifice disposed at between the distal end and the guide member. The orifice may be configured to receive a threaded fastener that engages the antenna assembly from opposite sides. In some cases, the guide member may be supported at a rear side of the antenna assembly by a reinforcement portion disposed at the rear side, the first and second end plates may be supported at respective side walls of the antenna assembly by respective instances of a threaded fastener, and a strap may be tightened across a front side of the antenna assembly such that the antenna alignment bracket is supported by four different structures at four respective sides of the antenna assembly. In an example embodiment, the reinforcement portion may include a steel structure providing rigidity to the antenna assembly and an attachment point for attaching the antenna assembly to a tower mast via a mounting bracket. In some cases, the alignment may be is configured to measure at least tilt, roll and azimuth of the antenna assembly. In an example embodiment, the guide member may have either a variable length or a fixed length. In cases where a fixed length is used, the fixed length may be longer than a width of the antenna assembly from a first side of the antenna assembly to a second side of the antenna assembly, and a threaded fastener may be provided at each of the first and second end plates to enable the antenna alignment bracket to engage the first and second sides of the antenna assembly leaving a space defined between the first and second end plates and the first and second sides, respectively.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An antenna alignment bracket comprising:

a guide member having a first end and a second end;

a first end plate disposed at the first end of the guide member to extend away from the guide member in a first direction that is substantially perpendicular to a direction of longitudinal extension of the guide member;

a second end plate disposed at the second end of the guide member to extend away from the guide member in the first direction; and an extension portion operably coupled to one of the first end plate, the second end plate, or the guide member at a proximal end of the extension portion, wherein the extension portion is configured to support an alignment tool bracket for holding an alignment tool configured to align an antenna assembly at a distal end of the extension portion, and wherein a receiving space is defined between the first and second end plates to receive the antenna assembly.

2. The antenna alignment bracket of claim 1, wherein the guide member is configured to engage a rear wall of a housing of the antenna assembly, and the first and second end plates are configured to extend parallel to respective side walls of the antenna assembly such that a front side of the antenna assembly faces away from the receiving space.

3. The antenna alignment bracket of claim 2, wherein the rear wall comprises a reinforcement member extending across the rear wall in a direction from a first side wall to a second side wall, the reinforcement member being substantially parallel to a plane in which a top wall of the housing of the antenna assembly lies.

4. The antenna alignment bracket of claim 3, wherein the guide member is configured to be operably coupled to the antenna assembly such that the guide member abuts the reinforcement member.

5. The antenna alignment bracket of claim 3, wherein the extension portion is configured to extend above the plane of the top wall responsive to operable coupling of the guide member to the antenna assembly.

6. The antenna alignment bracket of claim 1, wherein each of the first and second end plates comprises a slot at a distal end thereof relative to the guide member, and wherein a strap is configured to pass between the slot of each of the first and second end plates across a front side of the antenna assembly.

7. The antenna alignment bracket of claim 6, wherein each of the first and second end plates comprises an orifice disposed at between the distal end and the guide member, the orifice being configured to receive a threaded fastener that engages the antenna assembly from opposite sides.

8. The antenna alignment bracket of claim 1, wherein the guide member is supported at a rear side of the antenna assembly by a reinforcement portion disposed at the rear side, the first and second end plates are supported at respective side walls of the antenna assembly by respective instances of a threaded fastener, and a strap is tightened across a front side of the antenna assembly such that the antenna alignment bracket is supported by four different structures at four respective sides of the antenna assembly.

9. The antenna alignment bracket of claim 8, wherein the reinforcement portion comprises a steel structure providing rigidity to the antenna assembly and an attachment point for attaching the antenna assembly to a tower mast via a mounting bracket.

10. The antenna alignment bracket of claim 1, wherein the alignment tool is configured to measure at least tilt, roll and azimuth of the antenna assembly.

11. The antenna alignment bracket of claim 1, wherein the guide member has a variable length.

12. The antenna alignment bracket of claim 1, wherein the guide member has a fixed length.

13. The antenna alignment bracket of claim 12, wherein the fixed length is longer than a width of the antenna assembly from a first side of the antenna assembly to a second side of the antenna assembly, and wherein a threaded fastener is provided at each of the first and second end plates to enable the antenna alignment bracket to engage the first and second sides of the antenna assembly leaving a space defined between the first and second end plates and the first and second sides, respectively.

14. A method of attaching an alignment tool to an antenna assembly, the antenna assembly comprising a housing having a rear wall, a first side, a second side, a top wall and a front side, the method comprising:

placing a guide member of an antenna alignment bracket proximate the rear wall such that a first end plate disposed at a first end of the guide member extends along the first side and a second end plate disposed at a second end of the guide member extends along the second side to receive the antenna assembly in a receiving space defined between the first and second end plates;

affixing the antenna alignment bracket to the antenna assembly; and operably coupling the alignment tool to an alignment tool bracket disposed at an extension portion of the antenna alignment bracket, the extension portion extending from one of the first end plate, the second end plate or the guide member.

15. The method of claim 14, wherein affixing the antenna alignment bracket to the antenna assembly comprises abutting the guide member to a reinforcement member extending across the rear wall in a direction from the first side to the second side, the reinforcement member being substantially parallel to a plane in which a top wall of the housing of the antenna assembly lies.

16. The method of claim 15, wherein affixing the antenna alignment bracket to the antenna assembly comprises affixing the antenna alignment bracket to the antenna assembly such that the extension portion extends above the plane.

17. The method of claim 15, wherein affixing the antenna alignment bracket to the antenna assembly comprises passing a first threaded fastener a first orifice in the first end plate to engage the first side, and passing a second threaded fastener through a second orifice in the second end plate to engage the second side.

18. The method of claim 17, wherein affixing the antenna alignment bracket to the antenna assembly comprises extending a strap from a first slot in the first end plate to a second slot in the second end plate and tightening the strap across the front side of the antenna assembly.

19. The method of claim 14, wherein affixing the antenna alignment bracket to the antenna assembly comprises sequentially abutting the guide member to a reinforcement portion disposed at the rear side, attaching a threaded fastener through each of the first and second end plates to engage the first and second sides, respectively, and tightening a strap across the front side of the antenna assembly such that the antenna alignment bracket is supported by four different structures at four respective sides of the antenna assembly.

20. The method of claim 14, further comprising adjusting a length of the guide member prior to placing the guide member of the antenna alignment bracket proximate the rear wall of the antenna assembly.

* * * * *